US005358040A

United States Patent [19]

Kinley et al.

[11] Patent Number: 5,358,040

[45] Date of Patent: Oct. 25, 1994

[54] METHOD AND APPARATUS FOR RUNNING A MECHANICAL ROLLER ARM CENTRALIZER THROUGH RESTRICTED WELL PIPE

[75] Inventors: Karl S. Kinley; Charles W. Agee, both of Houston, Tex.

[73] Assignee: The Kinley Corporation, Houston, Tex.

[21] Appl. No.: 915,941

[22] Filed: Jul. 17, 1992

[51] Int. Cl.[5] ..... E21B 17/10

[52] U.S. Cl. ..... 166/241.3; 166/242; 175/325.3

[58] Field of Search ..... 166/241.3, 241.1, 242, 166/243, 380; 175/325.3, 325.2

[56] References Cited

U.S. PATENT DOCUMENTS

| | | | |
|---|---|---|---|
| 2,899,633 | 4/1956 | Smith et al. . | |
| 2,971,582 | 2/1961 | Marsh . | |
| 3,200,884 | 8/1965 | Solum et al. . | |
| 3,575,239 | 4/1971 | Solum | 166/241 |
| 4,425,966 | 1/1984 | Garney | 166/241 |
| 4,506,219 | 3/1985 | Lee | 166/241 |
| 4,557,327 | 12/1985 | Kinley | 166/241 |
| 4,615,386 | 10/1986 | Briscoe | 166/241 |
| 4,619,322 | 10/1986 | Armell et al. | 166/241 |
| 4,757,873 | 7/1988 | Linyeav et al. | 181/105 |
| 4,776,397 | 10/1988 | Akkerman | 166/241 |
| 4,793,412 | 12/1988 | Rivas et al. | 166/241 |
| 4,794,986 | 1/1989 | Langer | 166/241 |
| 4,830,105 | 5/1989 | Petermann | 166/241.1 |
| 4,871,020 | 10/1989 | Rivas et al. | 166/241 |
| 4,912,683 | 3/1990 | Katahara et al. | 367/25 |
| 4,913,230 | 4/1990 | Rivas et al. | 166/241 |
| 4,916,648 | 4/1990 | Gard | 367/35 |
| 4,960,173 | 10/1990 | Cognevich et al. | 166/241.1 X |

FOREIGN PATENT DOCUMENTS

| | | | |
|---|---|---|---|
| 2173533 | 10/1986 | United Kingdom | 166/241.1 |

*Primary Examiner*—Terry Lee Melius
*Attorney, Agent, or Firm*—Sue Z. Shaper

[57] ABSTRACT

Method and apparatus for running a mechanical roller arm centralizer through restricted well pipe including roller arms with staggered longitudinal height and limitations upon extension and compression of the arms.

17 Claims, 10 Drawing Sheets

FIG. 1
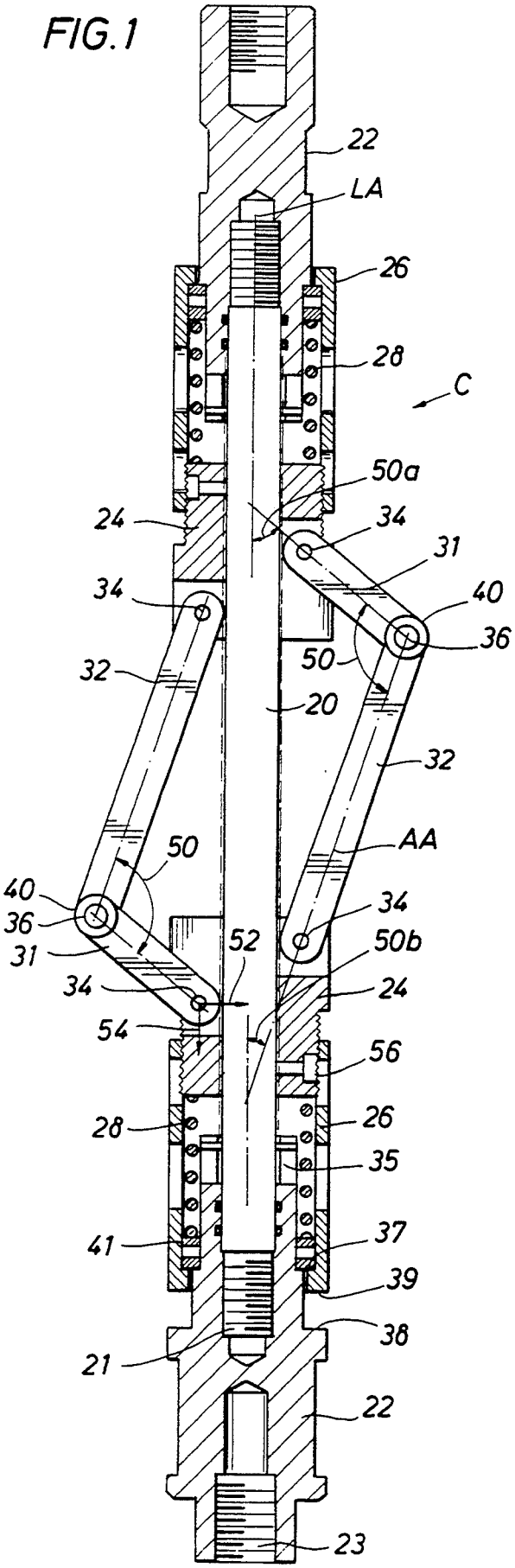
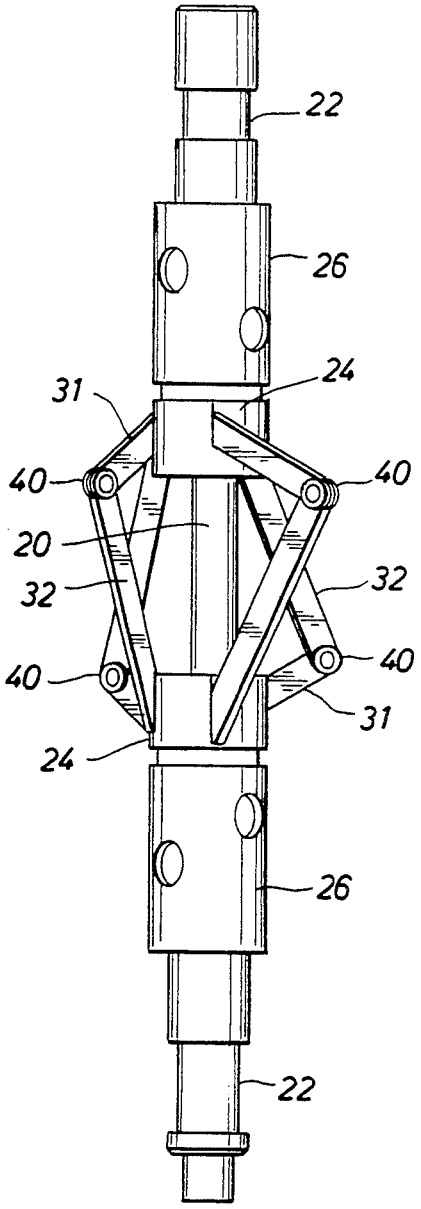
FIG. 2

FIG.5A
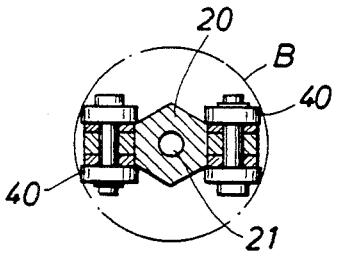
FIG.5B
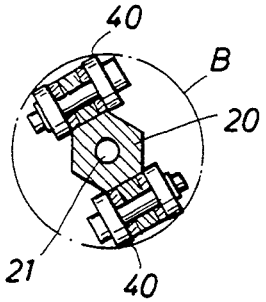
FIG.5C
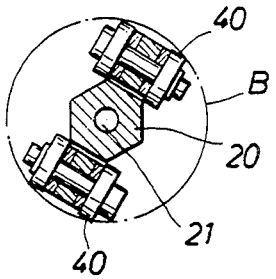
FIG.5D
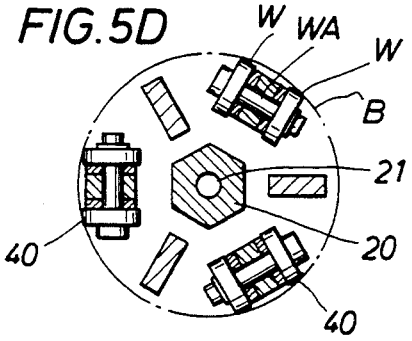
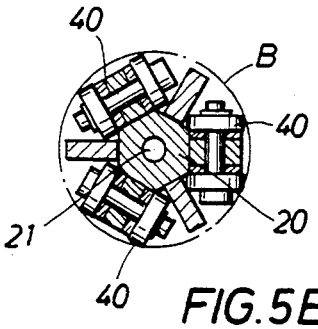
FIG.5E
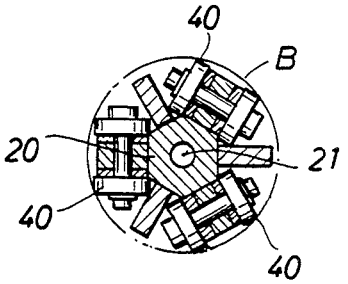
FIG.5F
FIG.6A
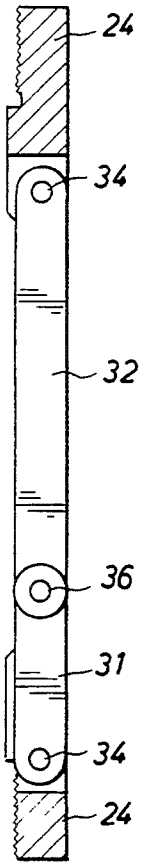
FIG.6B
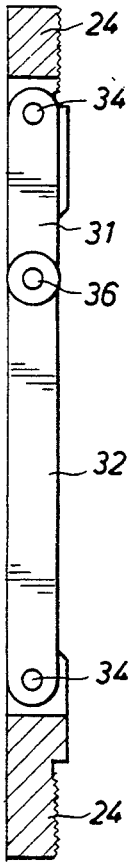
FIG.6C
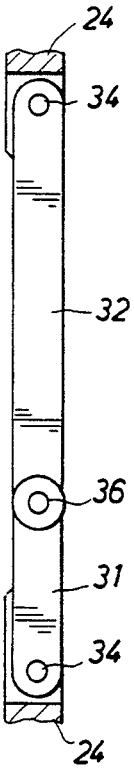
FIG.6D
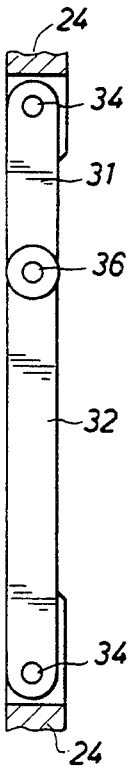
FIG.6E
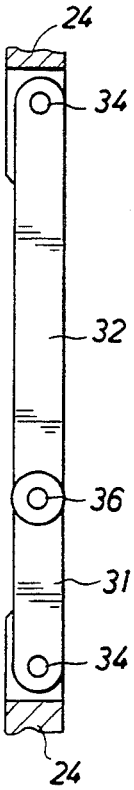
FIG.6F
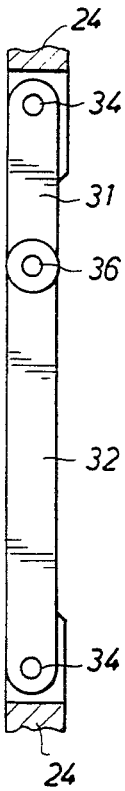

METHOD AND APPARATUS FOR RUNNING A MECHANICAL ROLLER ARM CENTRALIZER THROUGH RESTRICTED WELL PIPE

FIELD OF THE INVENTION

The present invention relates to a roller arm centralizer for centering an oil well tool while running in a well bore.

DESCRIPTION OF THE PRIOR ART

While running tools in a well bore or well pipe, it is frequently desirable to maintain the tools centered in the bore. Centralizers are employed in the string for this purpose.

Different designs of oil well centralizers are known, depending, for instance, upon whether the centralizer is designed to work in place in the well permanently, upon whether the centralizer is to be movable or fixed in operation, or upon whether the centralizer is to be used to run with a tool in and out of the well through sections of varying diameters.

U.S. Pat. No. 3,575,239 to Solum and U.S. Pat. No. 4,794,986 to Larger offer examples of bow spring centralizers designed to center well pipe within the bore. They remain permanently in place and are essentially immovable, after location. Such centralizers are designed with a plurality of outwardly extending bow springs placed between a pair of collars. The bow springs make frictional contact with the bore.

U.S. Pat. Nos. 4,793,412, 4,871,020 and 4,913,230 to Rivas illustrate a centralizer designed to center a polished rod and/or piston stem of a subsurface pump during production within a specified segment of pipe. These centralizers are designed to remain mobile but to work permanently within a given section of the well with a given diameter.

Centralizers designed to be temporarily inserted into and removed out of a well, and to be run through and centralize through a plurality of different well pipe sections with differing diameters, face different problems than the centralizers mentioned above. For one point, the above centralizers are designed to function within a given section of the well, either movably or fixed in place.

The different problems faced by non-permanent, or temporary, moving centralizers dictate different designs. This invention relates to the improved design of centralizers to be run with tools wherein the tools and centralizers are inserted into and removed out of the well and run through a plurality of sections of pipe or bore with differing diameters.

Of centralizers directed towards performing the same functions as the present invention, U.S. Pat. No. 4,776,397 to Akkerman illustrates a roller arm centralizer having outwardly biased arms with rotating contact points. Akkerman, however, presumes that the tool is run on a conducting line that allows for the use of a cocking and decocking mechanism. Thus, Akkerman can teach motorized means to retract these arms upon command from the surface in order to accommodate problems in running through restrictions and differing diameters of pipe. The present invention, in contrast, presumes that the force biasing the arms outwardly from the body toward the bore or pipe cannot be altered or changed upon command from the surface. The present invention is directed toward a mechanical centralizer that can be run on nonconductive line. It, therefore, offers a different solution to the problems involved in accommodating pipe restrictions and differing diameters of pipe.

U.S. Pat. No. 4,557,327 to Kinley and U.S. Pat. No. 4,619,322 to Armell illustrate outwardly biased mechanical roller arm centralizer designs where the biasing means is not alterable upon command from the surface. The present invention is directed to an improvement in such designs to solve problems encountered in passing through restrictions and pipes of different diameters.

The centralizing force required of a mechanical roller arm centralizer is dictated by the weight of the string to be centralized and by whether the centralizer must centralize in deviated well applications.

The greater the weight of the string to be centralized, the stronger the biasing means or centralizing forces required. Since today's centralizers must have the ability to centralize in deviated well situations, a given weight of a string requires an even greater centralizing force and a stronger biasing means than it would in strictly vertical operations. For this reason, it has become undesirable to increase the weight of a string.

The solution of the prior art to passing a centralizer through pipe restrictions is in tension with this desire to minimize the weight of the string.

In running a tool with a centralizer downhole, the string must pass through pipe of various diameters, as mentioned above. The change in diameter is encountered as an assortment of restrictions. Concentric restrictions are the most common. Typical restrictions are landing nipples, tubing size changes or cross-overs and/or valves. A centralizer with a strong force biasing the arms outward requires a greater force to compress the arms to pass through restrictions. A present technique of the prior art utilized to increase the force acting to compress the arms to aid the centralizer to pass through a restriction is to increase the weight, and thus the momentum, of the string. A second solution practiced in the art is to raise the centralizer, when it sticks, and drop it through the restriction with a greater velocity, thereby also increasing the momentum.

There is a downside with each of the above solutions. As discussed,the greater the weight of the string, the greater the centralizing force and biasing strength required, and for deviated well applications, the sensitivity of the biasing strength to increased weight is heightened. A catch-22 type situation can develop where the added weight requires a greater biasing strength, which in turn requires added weight. This may result in the situation where the tool runs off center regardless of how much more effective the centralizers are made. Further, some tools, in particular the downhole tools to which the present invention is particularly directed, have their function impaired if the string is backed up while it is being lowered in the well.

Operators familiar with the problems of running slick line tools are particularly familiar with the specific problem of getting centralized tool strings to fall out of the lubricator and through the tree. When a centralizer tool string is pulled up into the lubricator, and then the lubricator connected to the top of the tree, a situation is created where only the weight of the tool string can make the line start to move through what is typically a very tight, sticky seal on top of the lubricator. Once the line starts to feed through this seal then lubricants can be added to the surface of the line as it feeds in. Also, once about 1,000 feet of the line gets below the seal, the weight of the line itself becomes significant enough to help feed the line through the seal.

A typical sequence of events for getting the tool to fall would be: (1) The tool string is pulled all the way to the top of the lubricator so that the top of the tool string is touching the bottom of the seal assembly inside the lubricator; (2) the lubricator is attached to the top of the valves that constitute the top of the oil well; (3) the lubricator is pressure tested to demonstrate that it will be able to contain the well pressure; (4) the valves of the tree are opened and the lubricator is pressured up by the well; (5) the line is slacked off and the tool string should fall out of the lubricator, pulling the line through the seal by virtue of its weight.

It is at this stage that operators sometimes find that the line will not feed through the seal. The line outside the seal will go slack and just gather around the well head or spool out of the wireline unit onto the ground. A typical procedure at this moment might include shaking the lubricator with the crane that holds it up. Another approach is reducing the amount of squeeze that is on the seal. This squeeze can be adjusted by reducing the pressure on the packing elements. This packing element pressure is controlled by a hydraulic system. Neither of these alternatives is recognized as "good" procedure. All operators want the tool string to just fall smoothly out of the lubricator, through the valves, and into the well bore, gently pulling the line behind it.

What has happened to centralizers in the past is that they would come to that first internal diameter change (it might be a valve, the bottom seal assembly of the lubricator, or some safety equipment in the tree) and require an incremental amount more force to pass through it. This moment of contact is the most crucial for the successful implementation of a strong centralizer design. The centralizer of one embodiment of the present invention helps to supply this need for an incremented amount more of force by a jostling motion. Another embodiment of the invention addresses the problem of the need for more force by a segmentation of the biasing force that must be overcome to achieve the internal diameter change. The centralizing force is segmented into elements that are overcome sequentially in time.

Two further design problems of roller arm centralizers having strong biasing forces are solved by the present invention. One problem arises for strong centralizers when the roller arms are compressed to their maximum against the centralizer body, as to pass through the smallest restriction possible for the design. If the axis of the arms is allowed to parallel the axis of the body, or worse, turn inwards, the biasing force is incapable of exerting a component in the direction necessary to re-extend the arms. Alternately, if the roller arms are allowed to extend outward such that their axis forms too great of an angle with the centralizer body axis, as for instance in passing through a wide portion of the pipe, the compressing force exerted by encountering and moving into a restriction has an undesirably small component in the direction necessary to compress the arms.

It is an object of the design of the present invention, therefore, to solve the above problems by disclosing a mechanical roller arm centralizer that, for a given necessary biasing strength, can pass through pipe restrictions more easily without adding unnecessary weight and without requiring that the centralizer be backed up and dropped with greater velocity. It is a further object of the invention to disclose a design for an interaction of roller arms with the body such that an outward component of force is exerted by the biasing means arms even when fully retracted or compressed. It is also an object of the invention to disclose a design of a centralizer that prevents the roller arms from opening too wide in order to maintain a component of force that operates to compress fully extended arms above a minimal level.

SUMMARY OF THE INVENTION

The invention comprises a mechanical roller arm centralizer for centering oil well tools while running in a well bore. The centralizer includes a body portion having a plurality of centering arms. The body portion may be comprised of several elements that are either fixedly or movably attached to each other, as is known in the art. For instance, the body portion may include a longitudinal bar or cylinder, with or without a longitudinal bore therethrough, subs attached to the ends of the bar and movable collars that slide partially over the bar and compress a spring between the collars and the subs. A pair of springs, or a source of biasing force, may be located at each end of the bar, as between a shoulder of a collar and a shoulder of a sub. Sleeves may adjustably attach to the collars, having shoulders and stops such that the sleeve limits the sliding movement of the collar over the bar. The bar and collar may be hexagonally or octagonally shaped to inhibit circumferential sliding or motion of elements of the body around the body's longitudinal axis. Designs other than that of the illustrated embodiment for the composition and interaction of the elements of the body portion, with its arms and biasing means, in general, are known in the art and could suitably implement embodiments of the present invention.

According to the present invention, a plurality of centering arms are pivotally connected to the body, or portions of the body. In preferred embodiments, six arms or eight arms would be utilized, a set of three or four arms forming a lower centering set and a set of three or four arms forming an upper centering set. Commonly, the arms are symmetrically spaced circumferentially about the body, e.g. either 120° apart or 90° apart when measured in a plane perpendicular to the longitudinal axis of the body. The arms have rotating contact points, or contact point assemblies, biased outwardly to contact the wall of the bore. In the illustrated embodiment, the rotating contact points or assemblies are comprised of a pair of wheels rotating over an axle attached to the outward juncture of two links that form one arm. Other forms of rotating contact points, however, are known to the art.

An element of the body assembly may limit the maximum outward extension of an arm. The value of such limitation is to assure that the compressing force on the contact point, when encountering a restriction in the bore, will have a maximally limited component in the radial direction and a minimally limited component in the longitudinal direction. The longitudinal component provides the force to compress the arms against the biasing means. The radial component does not perform this work.

A common biasing force used in mechanical roller arm centralizers is comprised of a spring or springs encircling a portion of the body. Commonly, all arms do work against one biasing force comprised of the spring or springs. This is the case in the first preferred embodiment illustrated. The biasing force, however, could be divided such that a first set of arms does work against a first biasing means and a second set of arms does work against a second biasing means. This is the case in an alternate embodiment illustrated. The centralizing force exerted by the device would be comprised of the sum of the forces exerted by the separate biasing means.

In the embodiments illustrated, the arms are comprised of two links, each link being attached at one link end to a movable collar that slides over a portion of the body and that compresses a spring biasing means. In the preferred embodiment, as one arm straightens to pass a restriction, all arms straighten, and the springs at both ends comprising a single independent biasing force are compressed at the same time. Alternately, in a more complex design, sets of arms may be connected to separate, independent biasing means. The total biasing force of the centralizer would be the sum of the separate biasing forces. In either manner, the arms can be connected to the body so that the total biasing force of the centralizer is overcome in stages as the centralizer passes into a concentric restriction.

In accordance with one preferred embodiment of the present invention, the arms are attached to the body so that when the centralizer is centered within a bore of uniform diameter, at least two, and preferably three, lower contact points, similarly biased and separated from each other circumferentially by at least 80°, have different longitudinal heights. The explicit provision of the circumferential separation is supplied because adding extraneous arms next to a lowermost arm and at the same longitudinal height, even similarly biased, would not significantly alter the performance of the instant invention. Similarly, adding an extraneous arm that was weakly biased, relatively speaking, would not alter the performance of the instant invention.

The longitudinal direction is the axial direction of the centralizer. Longitudinal height is used herein to mean, when one end of the centralizer is adopted as down and the other end is adopted as up, the distance up the longitudinal axis measured from the downward end.

A lowermost contact point is a contact point (one or more) that has the lowest longitudinal height when the centralizer is centered within a symmetrical bore. Centralizers of the prior art have a set of lowermost contact points, as well as a set of uppermost contact points, symmetrically located circumferentially around the body and biased by a similar force. In contrast, in one embodiment of the present invention, the arms are attached to the body such that there is one lowermost contact point. This point does not have the same longitudinal height as a second most lower contact point, or at least a second most lower contact point that is separated circumferentially by at least 80° and biased by a similar force. It is recognized that an extraneous contact point could be added at the same longitudinal height as the lowermost point. If the extraneous point were not separated by 80° or more circumferentially from the lowermost point, or if it were biased by a weaker force, its effect would be negligible.

Preferably, in the present invention, as illustrated in one embodiment, the at least three lowest contact points, separated circumferentially from each other by at least 80°, have different longitudinal heights. That difference in longitudinal height between two points may vary from 0.1 of an inch to 1 inch.

In an alternate embodiment, at least two sets of points comprised of at least two contact points each, the points within each set being symmetrically spaced from each other around the body, are located at different set longitudinal heights. The points within each set are located at the same longitudinal height. Each set is connected to a separate independent biasing force such that compressing one set of contact points requires overcoming less than the total biasing force or centralizing force of the centralizer.

In operation, at least one centralizer is attached to the tool string to be run in the well. The centralizer has outwardly biased centering arms pivotally connected to the body with rotating contact points, or contact point assemblies. The string is lowered through the well. Initially, the diameter of the bore may be so great, and the maximum extent of the reach of the arms may be limited, so that the arms do not yet fully centralize.

When a concentric restriction is encountered in the well bore, the centralizer will be jostled through the restriction in one embodiment. Jostling results from the sequential encountering of the restriction by individual contact points. A lowermost (or an uppermost) contact point and a second lower (or upper) contact point, separated circumferentially from each other by at least 80° and biased similarly, do not encounter the restriction simultaneously, but rather in sequence. Such jostling tolerates a momentary limited lack of alignment of the centralizer longitudinal axis with the axis of the bore in order to achieve, among other effects, a lengthening of the time over which the arms will be compressed to pass into the restriction. It has been found that by such jostling, a centralizer of a given centralizing force, weight and velocity can be passed through smaller concentric restrictions in the bore than can a similar centralizer designed according to the prior art techniques.

In an alternate embodiment using multiple independent biasing means, a lowermost symmetrically spaced set of contact points enters the restriction before a second next lower set, each set working against a separate independent biasing force. In such manner the total biasing or centralizing force of the centralizer is overcome over a greater period of time than in prior art designs where all lower contact points enter the restriction simultaneously.

Further embodiments of the invention include means for preventing a portion of an arm of the centralizer from axially aligning with the body axis. The invention also includes means for preventing the arms from extending outwardly from the body at greater than a preset angle.

BRIEF DESCRIPTION OF THE DRAWINGS

FIG. 1 is a longitudinal cross-sectional illustration of a centralizer, shown with only two arms illustrated.

FIGS. 2 and 3 are elevational views of a preferred embodiment of the centralizer.

FIGS. 5A–F offer a plan view partially illustrating the location of the body of the centralizer and the contact point assemblies around the body.

FIGS. 6A–F illustrate a means for attachment for double link arms to collar portions of a body to achieve a variation in longitudinal height for the contact point assemblies.

DESCRIPTION OF THE PREFERRED EMBODIMENTS

FIG. 1 illustrates in cross-sectional relief typical elements of a mechanical roller arm centralizer C. The centralizer, as portrayed, shows only two double link arms, one representative of a lower set of arms and one representative of an upper set of arms. LA indicates the longitudinal axis of the centralizer body. The cross-sectional view illustrates one means by which arms can be connected to the body and biased outwardly, as discussed in more detail below, to provide the centralizing force.

Figure 3:
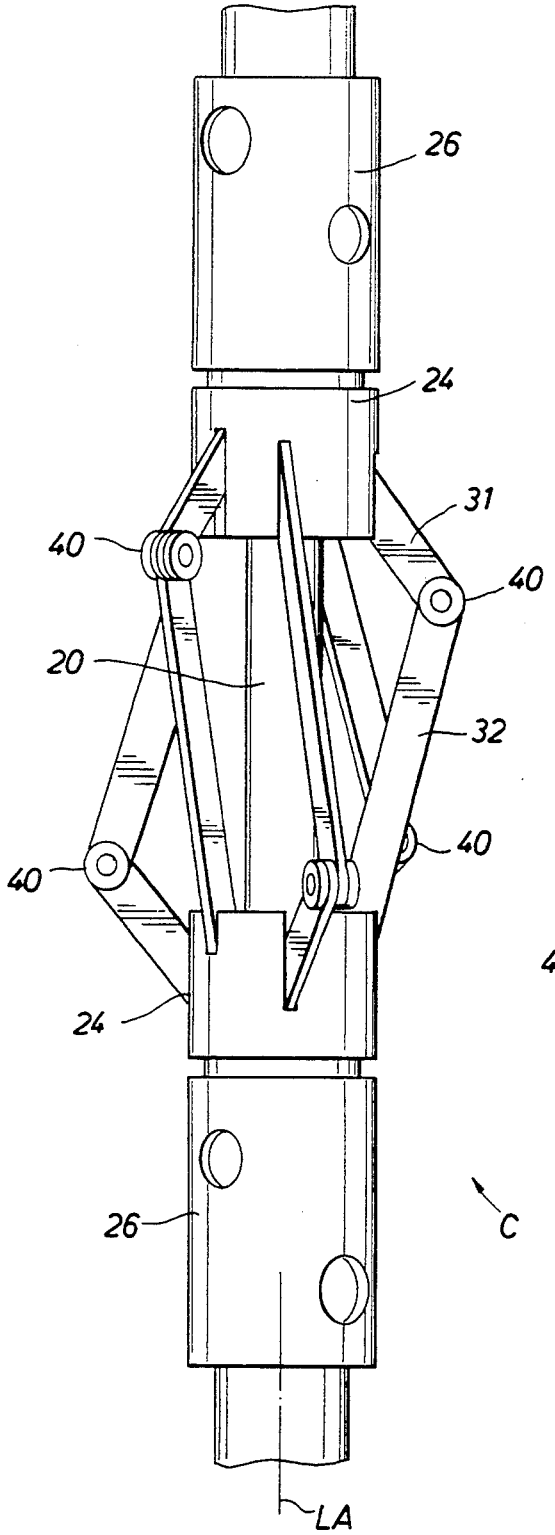

FIGS. 2 and 3 offer elevational views of a preferred embodiment of a mechanical centralizer of the present invention, which embodiment is of the type of centralizer illustrated in FIG. 1. The embodiment of FIGS. 2 and 3 is comprised of six circumferentially spaced arms; three arms bear lower contact point assemblies 40, and three arms bear upper contact point assemblies 40. The arms are attached to the body such that the three lower contact point assemblies are spaced circumferentially approximately 120° from each other and are staggered in longitudinal height, as measured along longitudinal axis LA. Likewise, the arms are also attached to the body such that the three upper rotating contact point assemblies are spaced approximately 120° from each other circumferentially and their longitudinal height is also staggered or varied when measured along longitudinal axis LA.

In the embodiment of the invention illustrated in FIGS. 2 and 3, all arms work against the same biasing force. The force is comprised of two springs located along each end of the body, more fully described below.

Other designs for roller arms and means for attachment of the arms to the body of a mechanical centralizer are known in the art. These are illustrated in part by the patents referenced above. For each such design of arms and body, to practice a first embodiment of the present invention, the arms should be attached to the body so that at least the lower two, and preferably three, contact points that are separated circumferentially by at least 80° have a staggered longitudinal height. It is proposed to effect the same staggered longitudinal height for the upper contact points.

If the biasing force of the centralizer is divided, as discussed more fully below as an alternate embodiment, such that one set of arms works against one biasing force and a second set of arms works against a second independent biasing force, then one skilled in the art, to practice the present invention, should attach the arms to the body to achieve a staggered longitudinal height between sets of contact points. At least the two lowermost sets of contact points should have differing longitudinal heights. It is proposed to effect the same for at least the two uppermost sets of contact points.

From FIGS. 1, 2 and 3 it can be seen, in the embodiment illustrated therein, that each arm is comprised of a short link 31 and long link 32. One end of short link 31 and one end of long link 32 is attached to an upper or lower slidable collar 24, which comprise part of the body portion of centralizer C. The other end of each link is joined at a common axis point 36, where rotatable contact point assemblies 40 are attached. Upper and lower collars 24 slide over central bar or tube 20. In the embodiment illustrated, collars 24 carry with them sleeves 26. Sleeves 26, as more particularly shown in FIG. 1, interact with subs 22 attached to the end of bar or tube 20 to restrict the longitudinal sliding motion of the collars 24 over bar 20, as more fully described below. In such manner the maximum extension radially out from the body of contact point assemblies 40 is limited.

In FIG. 1 bar or tube 20 is illustrated with partially dashed lines. The dashed lines indicate that bar or tube 20, in the preferred embodiment, has a hexagonal, or multifaceted, exterior surface. Collars 24 that slide over bar or tube 20 have a corresponding hexagonal or multifaceted inner bore surface. Such design limits the rotation of the collars around the bar or tube.

FIG. 1 illustrates the placement of two biasing springs 28 between body subs 22 and collars 24. Sleeve 26, adjustably attached to collar 24, such as by screwing on to pin end 56 of collar 24, slides over sub 22. Its movement is limited by stop shoulder 38 on sub 22 and stop shoulder 37 on ring 41, interfacing with spring 28 on sub 22. In such manner the longitudinal movement of collar 24 over bar or tube 20 is limited. By limiting the sliding movement of collar 24 over bar or tube 20, angle 50 between longitudinal axis AA of link 31 and longitudinal axis AA of link 32 will not contract below some minimum angle. Thus, the contact point assemblies 40, carried at axes 36, where the short links and long links join, will not be permitted to expand radially beyond a given distance from body 20.

Alternately, arm links 31 and 32, having axes AA, form angle 50*a* between axis AA of short link 31 and body axis LA. It is desirable to limit angle 50*a* to 45° or less. Such angle limitation can be obtained by limiting the longitudinal movement of collars 24 over bar or tube 20.

In the embodiment illustrated, a pair of springs 28 comprise the biasing force. Other biasing forces for mechanical roller arm centralizers are known in the art and could be utilized with the present invention.

The arms of the embodiment illustrated, as discussed above, are designed with longer links 32 and shorter links 31, each pivoted to the body at pivot points 34 on collars 24. In the embodiment more fully illustrated in FIGS. 6A–6F, the lengths of the links of the arms and the placement of pivot points 34 on collars 24 are interrelated such that the longitudinal height of pivot points 36, found at the junction of the two links comprising one arm, can be staggered, as measured along longitudinal axis LA.

Figure 4A:
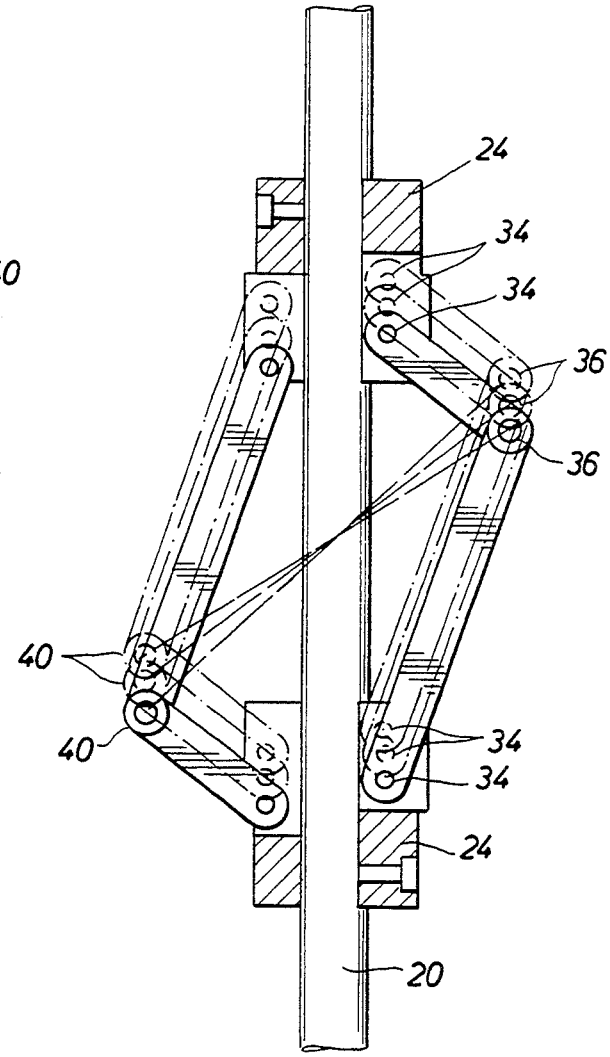
FIG. 4A offers a comparative illustration of the staggered longitudinal heights of the contact points of a preferred embodiment of the centralizer, showing three arms forming an upper set of contact points and three arms forming a lower set of contact points, with the arms shown as if not spaced circumferentially for visual comparison.
Figure 4B:
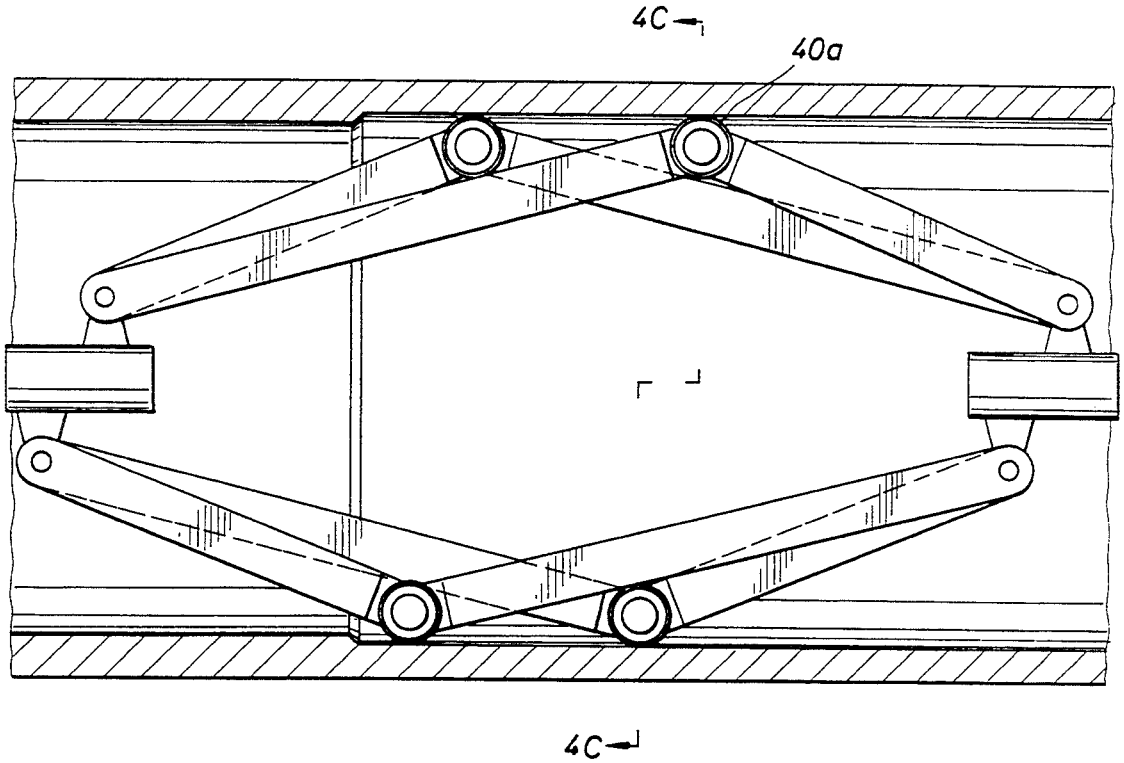
FIG. 4B offers a simplified illustration of the staggered height of the contact points for two arms on a centralizer of a preferred embodiment, shown approaching a restriction in a bore, the arms shown as if not spaced circumferentially for visual comparison.
Figure 4C:
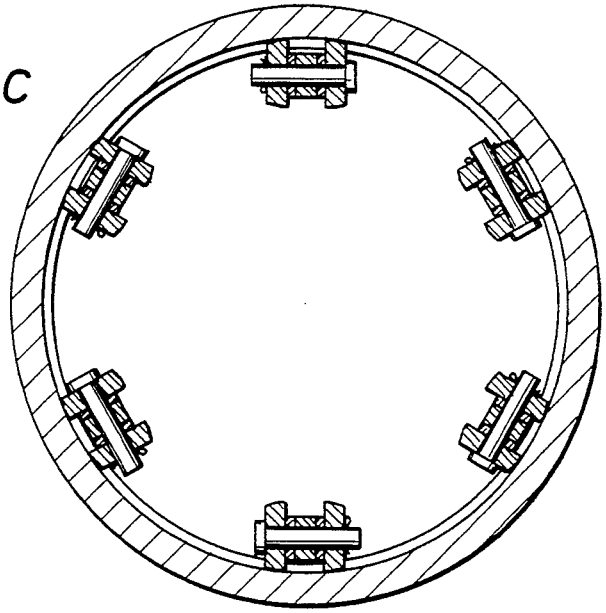
FIG. 4C illustrates, in a plan-type view, the typical symmetrical placement, circumferentially, of six contact point assemblies around the body of a centralizer.

FIGS. 4A and 4B offer an illustrative cross-section of certain features of a preferred embodiment. In FIGS. 4A and 4B the centralizer arms are illustrated, for demonstrative purposes only, as if all contact points were separated circumferentially by either 180° or 0°. For instance, in FIG. 4A, upper and lower contact point sets are grouped together, with no circumferential spacing, for illustration purposes. In FIG. 4B an upper pair and a lower pair of contact points are illustrated as if separated by 180°, for illustration purposes. In this manner, FIGS. 4A and 4B more clearly illustrate the staggered longitudinal heights of the contact points 40, and contact point axes 36, both for a lower set of contact points and an upper set of contact points. The cross-sectional view of FIG. 4C, taken on a plane perpendicular to the line through contact assembly 40*a* of FIG. 4B, and omitting representation of certain portions of the centralizer, illustrates the normal circumferential spacing of the contact points or assemblies, as well as the fact that, in the preferred embodiment, only one contact point contacts the bore in the plane perpendicular to the bore at that assembly 40*a*.

FIGS. 5A through 5F illustrate a plan view of bore B containing selected elements of the embodiment of centralizer C, namely body portion 20 with hexagonal outer surface and contact roller assemblies 40. FIGS. 5A through 5F serve to illustrate typical roller contact point assemblies 40, comprised, as illustrated in FIG. 5D, of two wheels W joined along wheel axis WA. An optional unobstructed longitudinal bore 21 inside of bar or tube 20 of the body is also illustrated in FIGS. 5A through 5F. This bore 21 forms an unobstructed bore through the whole of the centralizer, which can be useful for the passage of lines.

FIGS. 6A through 6F illustrate, as discussed above, one embodiment for the attachment of centering arms to body portion collars 24. The design of the attachment is illustrated for six arms, whereby a staggered longitudinal height of pivot points 36 for the rotating contact points 40 is achieved.

Figure 7A:
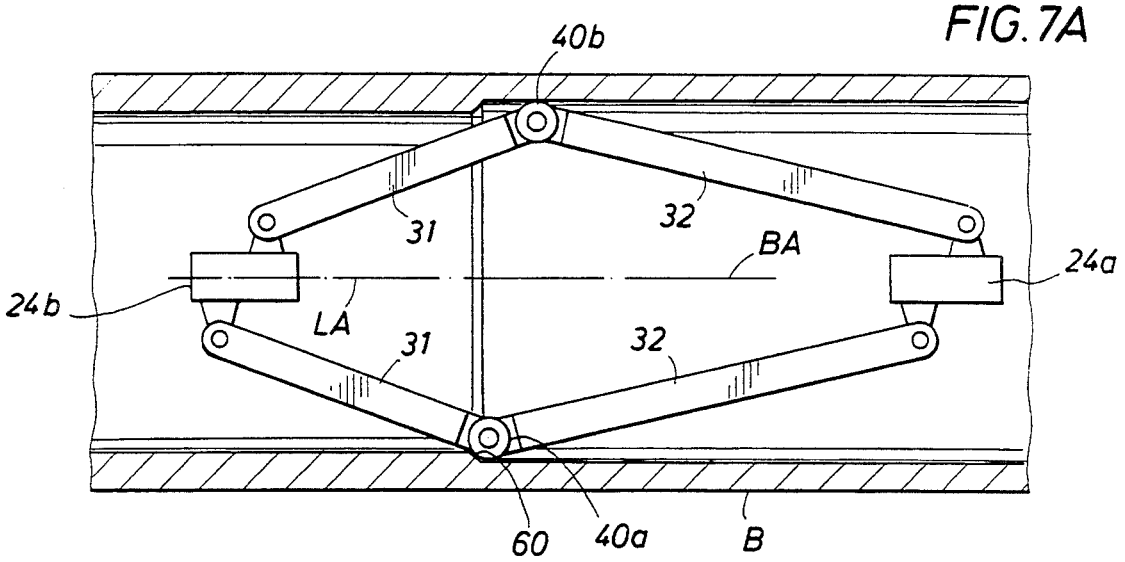
FIGS. 7A–C illustrate the jostling phenomena in a simplified example.
Figure 7B:
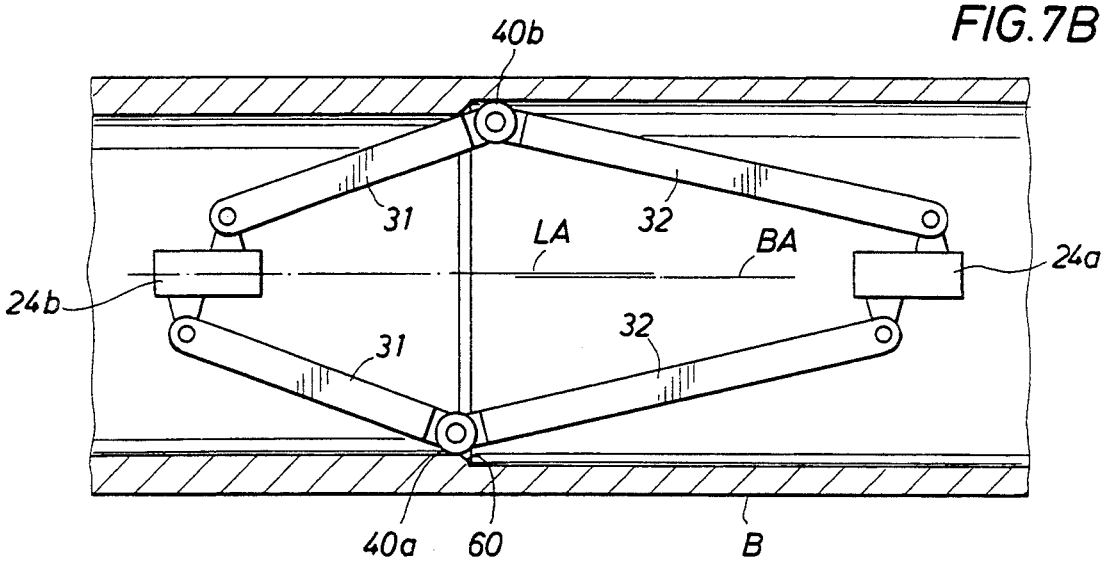
Figure 7C:
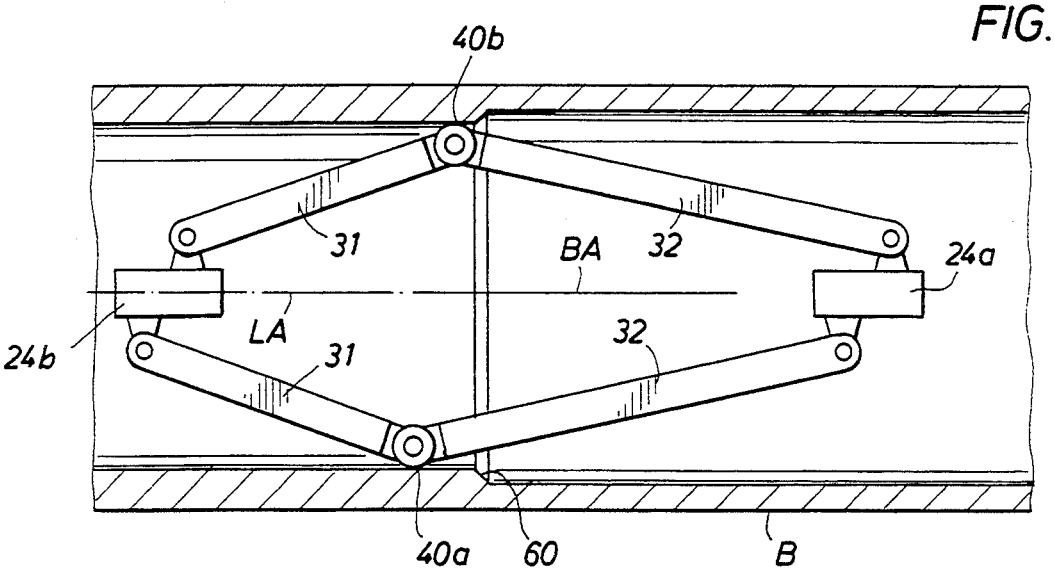
Figure 8A:
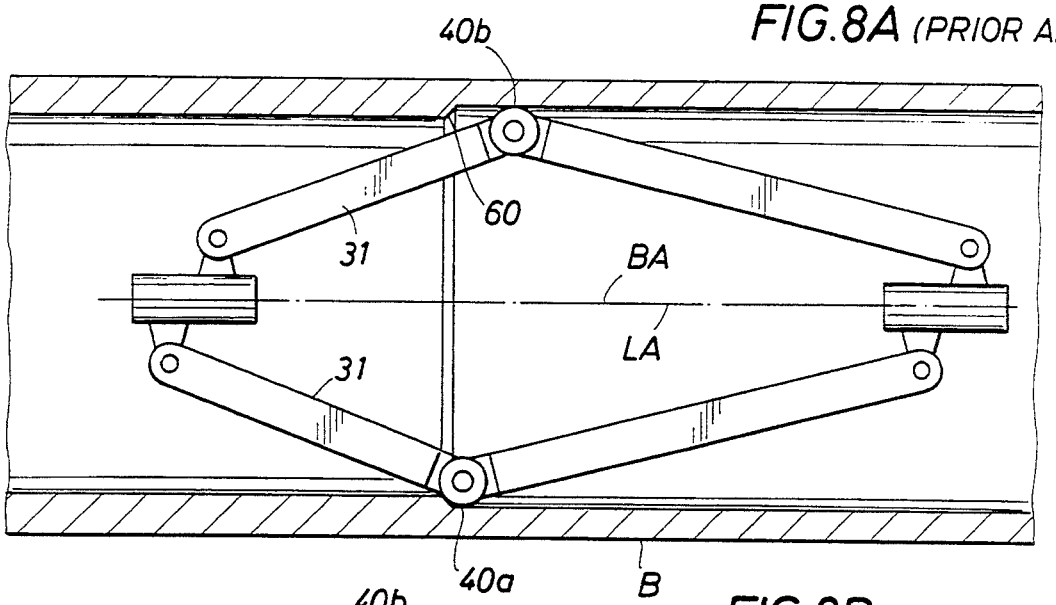
FIG.8A (PRIOR ART)
FIGS. 8A–C illustrate the movement of the same equipment as in FIG. 7, but hypothetically imposing no jostling, for comparison.
Figure 8B:
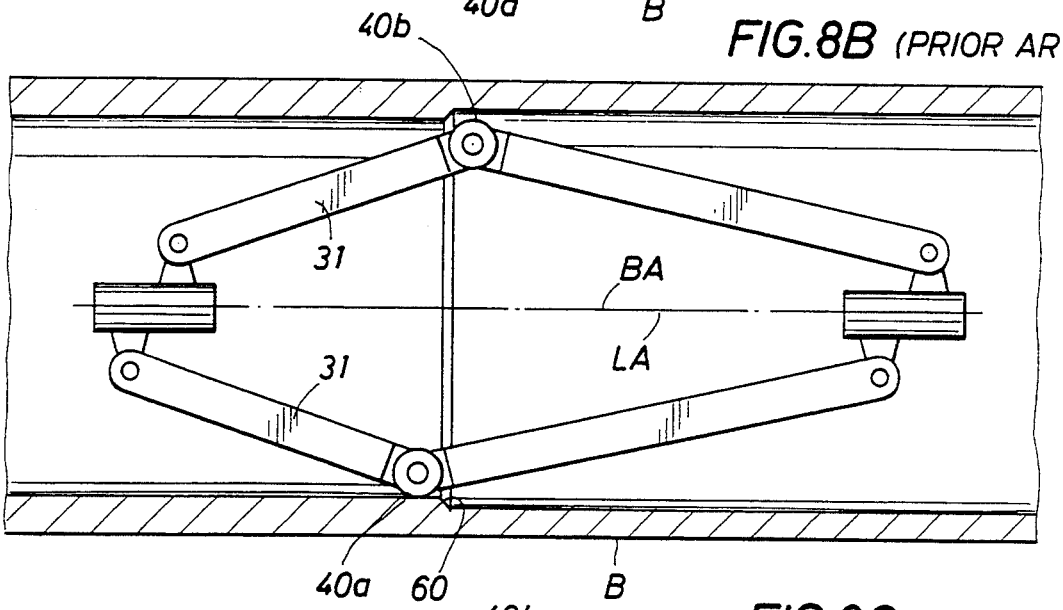
FIG.8B (PRIOR ART)
Figure 8C:
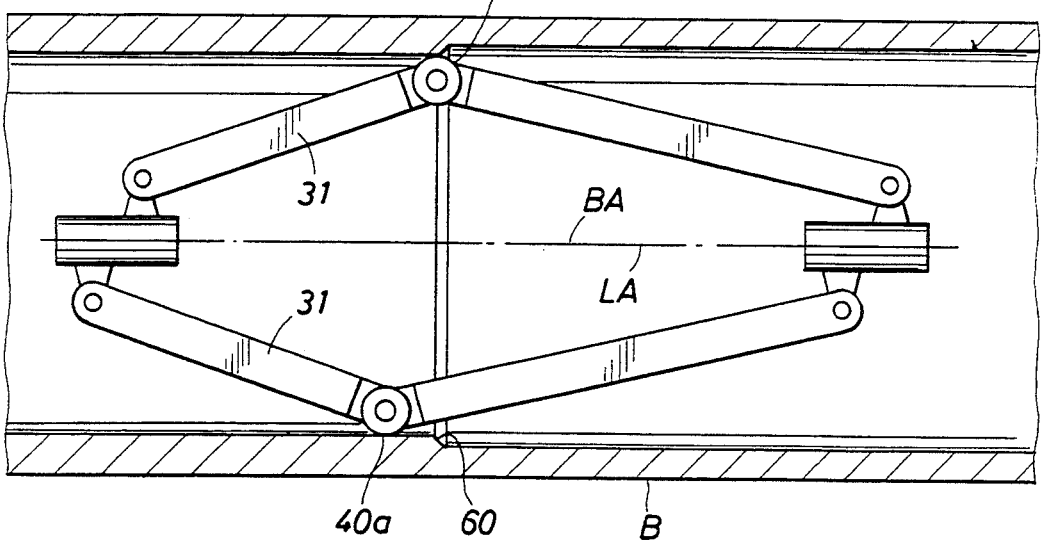
FIG.8C (PRIOR ART)

FIGS. 7A–C illustrate by simplified example the jostling motion of a centralizer of the present invention. FIGS. 7A–C utilize, for ease of presentation, a two arm centralizer wherein the arms are separated by 180°. It can be noted, as similarly illustrated in FIG. 4B, that the contact points or wheels do not contact the wall of the pipe in the same plane, measured perpendicular to the axis of the bore. FIGS. 8A–C are presented for comparison purposes.

The purpose of the illustrations in FIGS. 7A–C and 8A–C is to simplify the explanation of the jostling phenomena. Bore B is shown with symmetrical restriction 60. It is assumed in FIGS. 7A, 7B and 7C that the centralizer, not fully shown, is moving from right to left. In FIG. 7A both sets of contact point assemblies 40*a* and 40*b* are expanded in the wider diameter portion of the bore, to the right of restriction 60 in the drawing. It is indicated in this example that short link 31 makes an angle of 22.325° with the longitudinal axis LA of the centralizer.

FIG. 7B shows the centralizer wherein lower contact points or wheels 40*a* have entered the restrictive portion of bore B to the left of restriction 60. The next lower points or wheels 40*b* are still within the wider expanse of bore B. Centralizer axis LA no longer coincides with bore axis BA, although the difference is difficult to illustrate since it comprises an angle of 0.07°. Both sets of contact points or wheels 40*a* and 40*b* have moved closer to the centralizer axis LA, measured in the radial direction, such that short link 31 now defines an angle of 21.614° with the axis LA. Collar 24*a* has, by the compression of both arms toward the centralizer axis, been moved away from collar 24*b*, thereby performing work against some biasing force of the centralizer, not shown.

In FIG. 7C both contact point assemblies are shown moved inside the restriction 60 of the bore. At this point the angle made by the short link 31 of each arm to the equalizer axis LA is 20.977 degrees.

FIGS. 8A, 8B and 8C illustrate how a centralizer of the prior art would have maneuvered through the restriction for a pseudo comparison. Importantly, in FIG. 8B, contact point assemblies 40*b* are shown as if they contracted to the diameter of the narrower portion of the bore at the same time as contact point assemblies 40*a*. Thus, in the period of time of the movement of the centralizer between FIG. 8A and FIG. 8B, which compares to the movement in FIGS. 7A to FIG. 7B, lower links 31 decrease their angle with the centralizer axis from 22.325 degrees to 20.977 degrees. The work exerted against the biasing force thus takes place over a longer period of time in the embodiment of FIGS. 7 than in FIGS. 8. This lengthening of time and jostling phenomena has been observed to result in an increased efficiency in the utilization of the momentum of the device. It might be noted that in the case of the hypothetical of FIG. 8, the axis of the equalizer LA does not deviate from the center line of the bore BA. There is no jostling effect on the centralizer.

In operation, returning to the preferred embodiment of FIGS. 2 and 3, the contact wheels on the six arms of the illustrated embodiment are arranged so that each wheel will contact the leading edge of a symmetrical restriction in the well bore at a different time, assuming the centralizer is centered within a generally symmetrical pipe and being lowered and/or raised. In the process of jostling the embodiment of FIGS. 2 and 3 through a restriction, it can be seen that by having only one wheel contact the restriction initially, instead of all three simultaneously, the centralizer will tend to move slightly off center when the restriction is first encountered. By moving slightly off center the centralizer is essentially moving away from the restriction and thereby reducing the amount that the arms must initially collapse in order to begin to pass into the restriction. Even though all of the arms are connected to one of two common hubs, or collars, the staggered orientation of the attachment creates the ability for each arm in a set to be in a different diameter of the well.

As the first wheel of the leading arm of the embodiment of FIGS. 2 and 3 encounters the restriction, this arm becomes the controlling arm which must compress the spring or biasing element in the centralizer. The restriction, pushing on the most forward wheel, will push the centralizer over to one side, slightly off the center line, and start to compress the centralizer spring.

The effect of a sequential contact is to increase the time required to depress the springs until all contact points circumferentially surrounding the centralizer longitudinal axis are compressed to pass within the smaller diameter of the restriction. Only a portion of the total depression of the spring or biasing means is needed initially, while the centralizer can shift its longitudinal axis. Under this design, the first wheel to hit the restriction is, in fact, only required to collapse the centralizer by an amount proportional to the radial difference of the new diameter to the previous diameter. This is a portion of the distance that would be required by a nonstaggered design in the same amount of downward travel. The rest of the required collapse of the centralizer arms is obtained by the following wheels. Experience with the invention of this embodiment indicates that the resulting off center movement and impact from lowering a centralizer of this design through a restriction results in a jostling of the centralizer through the restriction that serves to aide in the efficient application of the weight and speed of the tool, or its momentum, to collapse the centralizer arms against their biasing means. Experience has demonstrated that by so jostling a staggered design, the weight required for a given tool strength can be minimized. This results in a benefit because the lighter the tool string, the easier it is to centralize in deviated wells.

Coupled with the staggered arm design of this embodiment of the present invention is a further design feature that provides for the ability to restrict the maximum opening diameter of the centralizer arms. Limiting the centralizer's maximum arm diameter can be an important feature in the design of a strong downhole centralizer. As illustrated in FIG. 1, the arm design of a centralizer in the embodiment illustrated is comprised of two pivoting links 31 and 32 that share a common axis junction 36 upon which the rotating contact points, or contact assembly, 40 is placed. As the angle 50 between the two links at the common axis junction decreases, it takes a greater force to collapse the centralizer arms by contact with a radially disposed restriction in the pipe or bore. The smaller angle 50 becomes, the larger becomes a noncompressing radial component 52 of the force on the arms applied by the encounter with the restriction, and the smaller becomes the compressing longitudinal component 54 of the force. A centralizer needed for operation in a 4½" pipe size might be required to fall directly out of a 7" lubricator. If the centralizer design does not allow for restricting the maximum diameter of its arms to that in the range of the 4½" size, a significantly greater expense of energy will be required to collapse the arms to enter the 4½" pipe.

The increase in time over which the momentum of a moving centralizer is used to work against its biasing force can be affected in an alternate manner. This design offers an alternate embodiment. In this embodiment the biasing or centralizing force to be exerted by the centralizer, such as by the springs, is a given set amount. However, the force itself is divided such that, for instance, one arm set works against one spring while a second arm set works against a second independent spring, the sum biasing force of the springs equaling the required biasing force. This design also permits the centralizer to perform over a lengthened period of time the work necessary against the biasing force in order to pass into a restriction. In this case the axis of the centralizer would not need to deviate from the axis of the bore.

Figure 9:
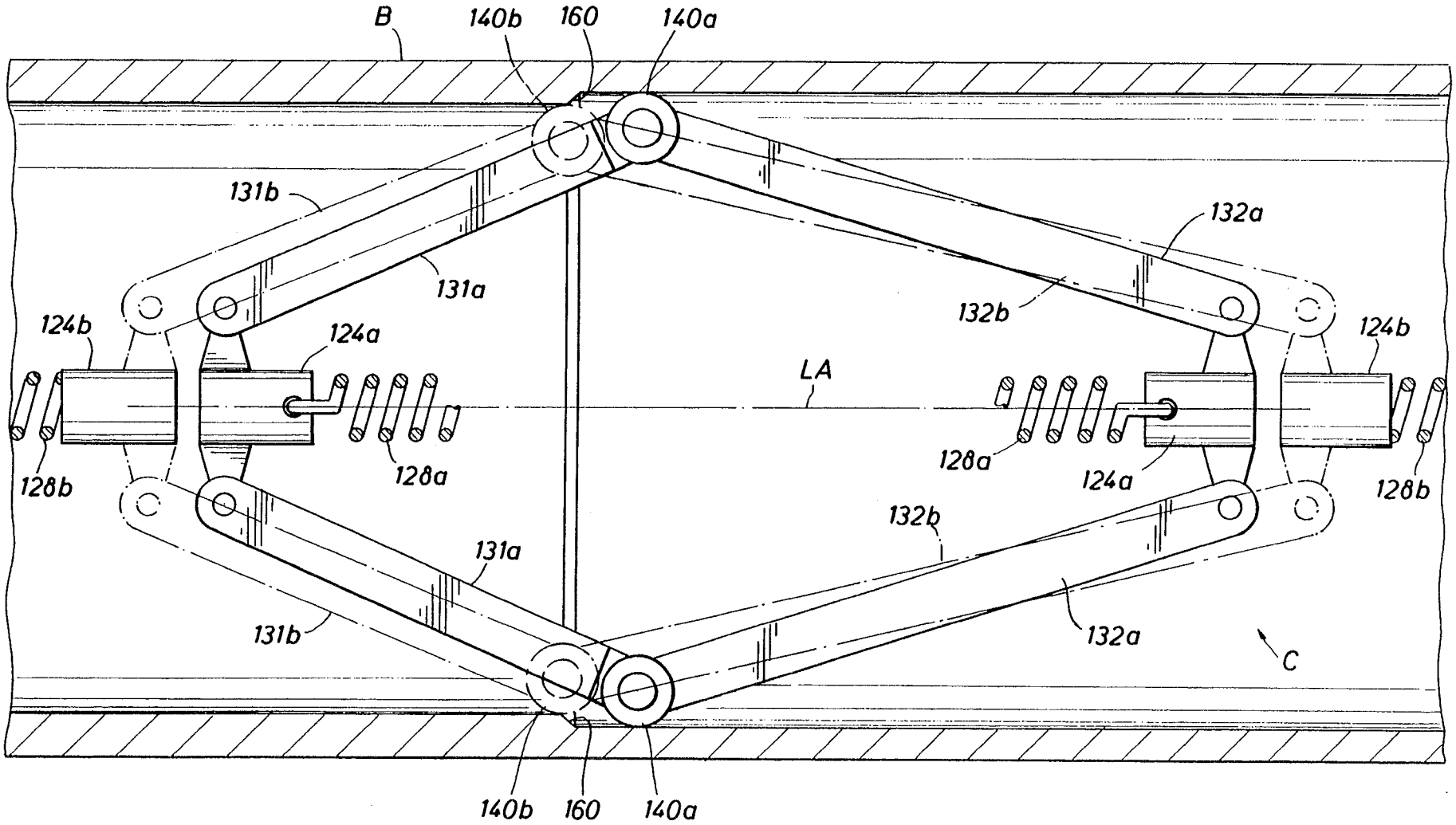
FIG. 9 illustrates in a simplified manner an alternative embodiment of a centralizer having two sets of two arms each, the contact points within each set separated 180°, wherein the longitudinal height of the first set differs from the longitudinal height of the second set, and each set is attached to a separate biasing force.

Thus, as illustrated schematically in FIG. 9, there could be two arms separated circumferentially by 180° with contact points **140*b* located at the same longitudinal height, or upon the same plane perpendicular to the axis LA of the centralizer. Likewise, there could be two arms separated circumferentially by 180° each having contact points or wheels 140*a* located at a different longitudinal height, or upon a different plane perpendicular to the axis of the centralizer. The arms connected to wheels 140*b* would be linked to a separate collars 124*a* from the arms containing wheels 140*a*. Thus, as the pair of wheels 140*b* contacted restriction shoulder 60 simultaneously they would compress against their biasing means 128*b*, which would be only a portion of the total biasing force of the centralizer. The longitudinal axis of the centralizer would not move or jostle from the longitudinal axis of the bore because wheels 140*b* would be located symmetrically around the centralizer, such as 180° apart. Preferably they would be located 90° or 120° apart. Likewise, when the arms carrying wheels 140*a* subsequently contact restriction shoulder 60 they would contract against their biasing means 128*a*, which again is a fraction of the total biasing force of the centralizer. Again, since wheels 140*a*** are located symmetrically around centralizer C, the longitudinal axis of the centralizer would not move from the bore axis. The total time, in this embodiment, over which the full biasing force is acted upon in order to pass within a restriction in the bore would be lengthened, as in the above first described embodiment.

Figure 10:
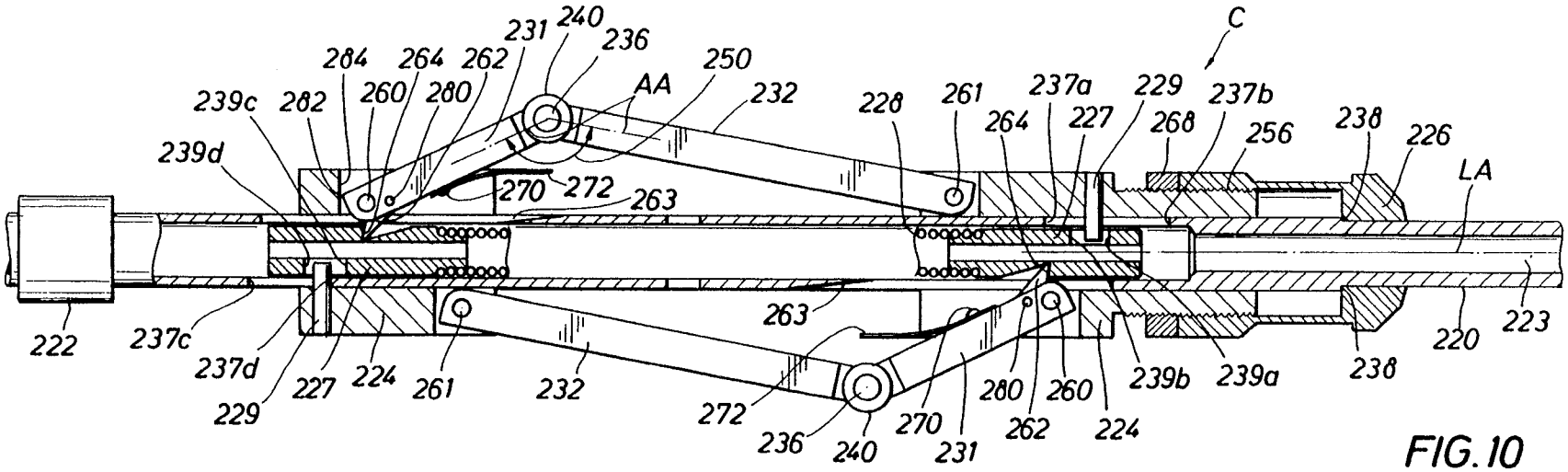
FIG. 10 is a cross-sectional illustration of an embodiment of the invention showing means for limiting the extension and compression of roller arms.
Figure 10C:
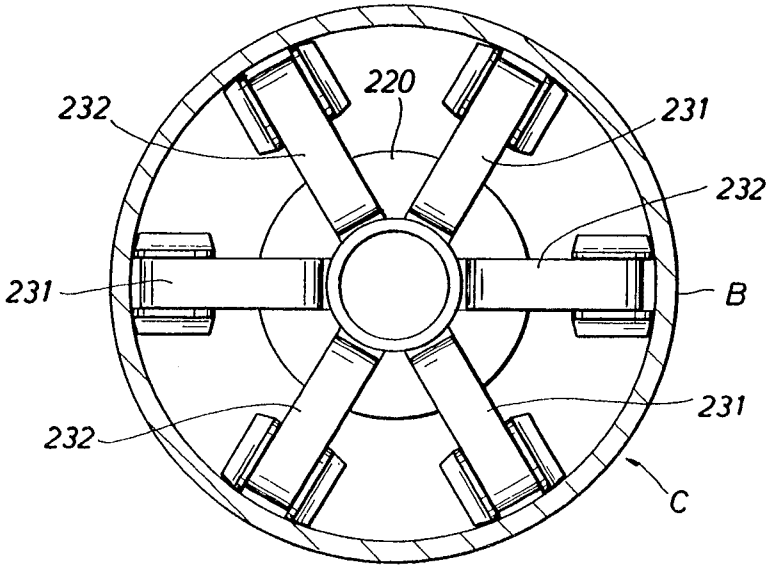
FIG. 10C provides an end view illustration of an embodiment of the type of FIG. 10.

FIG. 10 illustrates a further alternate embodiment of a mechanical roller arm centralizer C, that in particular illustrates means to prevent the arms from collapsing straight against the side of the body of the centralizer, as well as means for preventing the arms from extending radially outward to excessive distances from the longitudinal axis of the centralizer. Whereas FIG. 10, as shown, illustrates only two arms on a centralizer, FIG. 10C offers an end view of a typical centralizer of the type of FIG. 10 that shows the standard utilization of six arms carrying rotating contact point assemblies symmetrically separated from each other in the circumferential direction.

In the embodiment of FIG. 10, centralizer body portion 220 contains within its bore 223 a biasing spring 228 attached at each end to movable spring subs 227. Spring 228 and spring subs 227 provide an unobstructed bore within themselves such that the centralizer as a whole offers an interior unobstructed bore for the passage of lines. The movement of spring 228 and spring subs 227 within bore 223 of body 220 is limited by stops or bolts 229 anchored in collars 224, which collars are designed for limited sliding motion over the exterior of body portion 220. Stops 229 extend through slots of body portion 220 that have stop shoulders **237*a*, 237*b*, 237*c* and 237*d*. Stops 229 also extend through slots in spring subs 227 having stop shoulders 239*a*, 239*b*, 239*c* and 239*d*. Stops 229 thus serve to generally limit the sliding longitudinal movement of both collars 224 upon the outside of body portion 220 and of spring subs 227 sliding within bore 223 of body portion 220**.

Right collar 224 (in the drawing) is attached to collar sub 226, as by screwing. Supplemental ring 268 aids in securing and maintaining the adjustment between collar sub 226 and right collar 224. Collar sub 226 is also designed for axial movement over body portion 220. However, the axial sliding motion of collar sub 226 to the left (in the drawing) is limited by stop shoulder 238 residing on the exterior of body portion 220.

The two arms illustrated carrying roller contact assemblies 240 are comprised of two links, short link 231 and longer link 232. As in previous embodiments, one end of each link is pivoted to a collar 224. The other ends of each link are pivoted together at pivot point 236, around which are attached contact roller assemblies 240. In the embodiment of FIG. 10 short link 231 is pivoted to collar 224 at a low pivot point 260, whereas longer link 232 is pivoted to collar 224 at higher pivot point 261. Low and high in each case reflects radial distance from the longitudinal axis LA of the centralizer. The function of offset pivot points and low pivot point 260 relates to means of the embodiment of FIG. 10 for preventing the longitudinal axis AA of a portion of the arms from aligning itself with the longitudinal axis LA of the centralizer.

What is being accomplished by offsetting the pivot points of the arm links is the providing for one link to not align with the body axis. The end result is no loss in minimum closed diameter and an increase in "applied force" throughout the range of motion (although the range of motion is slightly reduced with the reduction in diameter of the pivot point location from the axis of the body). If both pivot points were dropped in diameter locations, there would be a "smaller" centralizer. The arms would come closer together at the pivot points, resulting in weaker components and more complexity. When one arm link is blocked from coming down to zero degrees then there is a centralizer with a larger minimum diameter.

Attached to short link 231, at pivot point 280, is cam 262. Cam 262 and a portion of short link 231 extend through a slot opening 263 in body portion 220 of the centralizer. Cam 262 contacts spring sub 227 at shoulder 264. Straightening of the arms comprised of links 232 and 231 results in the extension of spring 228 by means of cam 262 forcing spring subs 227 to separate in the longitudinal direction. Separating spring subs 227 by means of cam 262 results in the spring subs moving away from each other a greater longitudinal distance as the arms close against the centralizer body than do collars 224 sliding over the exterior body portion 220.

Further, the cam addresses one of the weaknesses of the basic centralizer arm concept. As illustrated in FIG. 10D, by applying force $F_B$ through cam 262 it is possible to compensate for the inherent problem associated with the geometry of the arms of centralizers. As the arms collapse toward the body, the force necessary to be applied to the wheels to collapse the arms is a function of the widening angle between the axes AA of links 231 and 232 and the narrowing angle between the arm link axis AA and the body axis LA. The wider the angle between the links and the smaller the link/body angle, the weaker the force required to be applied inward of the wheels to overcome a constant axial force $F_B$ at the pivot points 260, in general. The leaf springs 272 under the arms address this variation in force required to collapse, but not as well as the cam does. The cam through its axis provides a torque upon the link arm 231 which results in countering the centralizing force by an outward moment of force $F_m$ at the wheel joint. The torque element is particularly effective when the angle between the arm link and the body axis is very small, or even zero, and serves to equalize the force required to collapse the arms when going from a collapsed condition to an angle between the link and the axis of about 30°.

Thus, the cam is superior to leaf springs for several reasons. The cam makes the spring extension per degree of arm rotation more for a given arm length. This also results in a biasing force that is increased more per degree of rotation of the arm at the low angles than without the cam. Proper positioning and timing of the cam with the arm results in a more uniform centralizing force at the wheel through the typical range of motion of the arm. The biasing force applied can therefore be used more efficiently. This results in lower biasing forces, thereby reducing the wear and tear on the components during operation. Leaf springs do not achieve this efficiency of force applied.

Figure 10A:
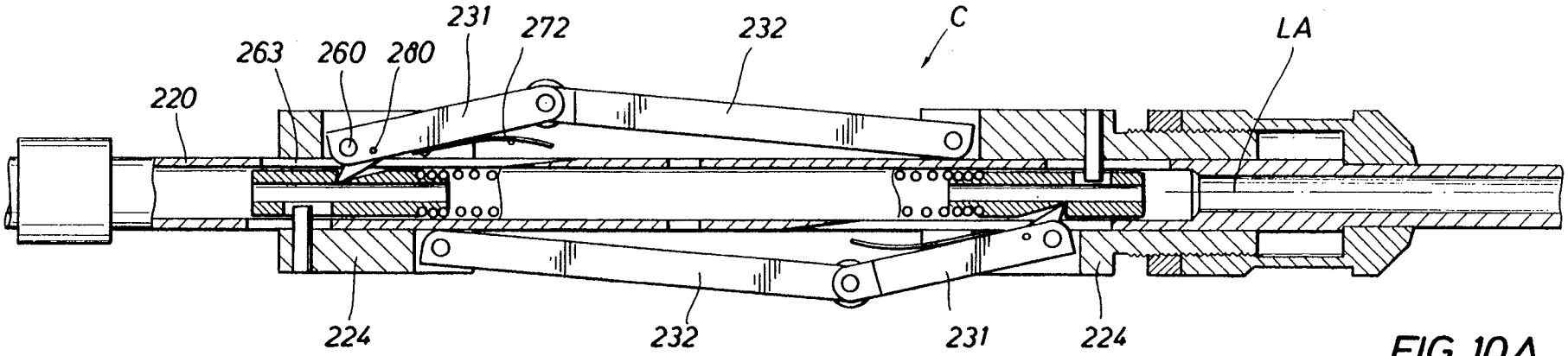
FIGS. 10A and 10B illustrate a centralizer of the type of FIG. 10 showing the arms in less extended and in compressed positions.
Figure 10B:
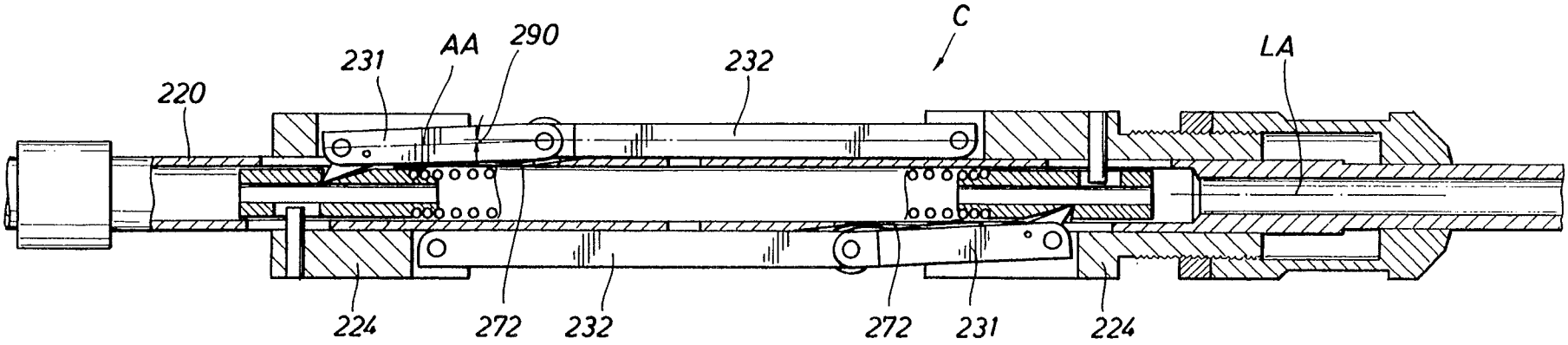
Figure 10D:
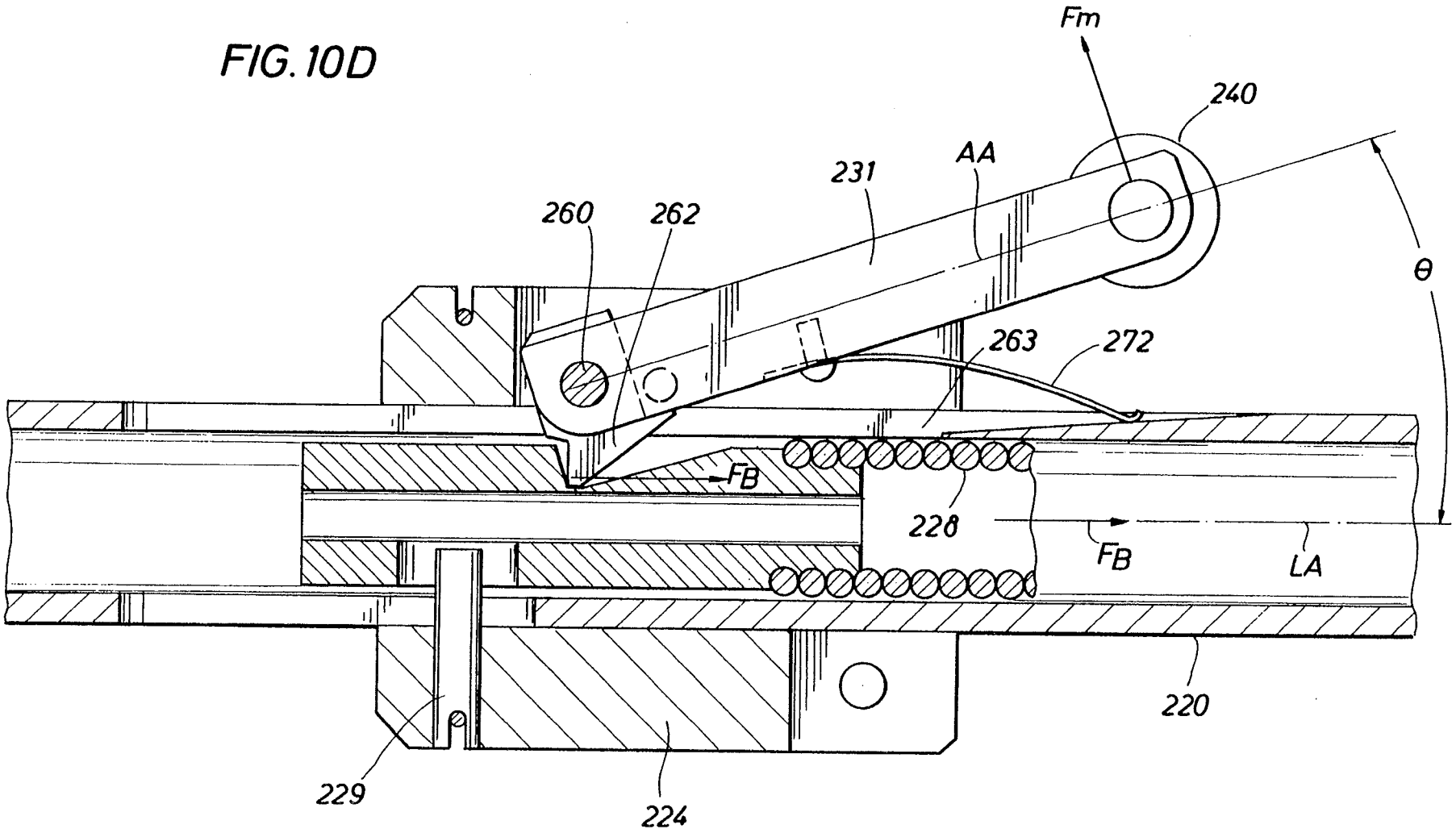
FIG. 10D provides an enlarged illustration of a portion of FIG. 10A.

FIGS. 10A and 10B illustrate the embodiment of FIG. 10 when the arms are positioned more nearly axially aligned with longitudinal axis LA of the centralizer. FIG. 10B illustrates the centralizer of FIG. 10 with the arms compressed to the maximum against the body. In the embodiment of FIG. 10, at maximum compression, longitudinal axis AA of arm link 231 makes angle 290 with a line parallel with longitudinal axis LA. Angle 290 is anticipated to be in the order of three degrees. Lower pivot point 260 connecting link 231 to sliding collar 224 aids in permitting link 231 to extend through slot 263 in body portion 220 and maintain angle 290 at greater than zero, and especially not negative.

Also illustrated in the embodiment of FIG. 10 is bolt 270 affixing leaf spring 272 to the side of link 231. Leaf spring 272 serves to bias link 231 outwardly from the exterior wall of body portion 220, tending to maintain the axis AA of link 231 not in alignment with, or parallel to, centralizer axis LA.

It can be seen from FIG. 10B that when a restriction that served to compress the arms of the centralizer to their maximum compression has been passed, biasing spring 238 will urge left spring sub 227 to the right. Cam 262, pivoted to arm link 231 at point 280, will thereby urge left upper arm link 231 both to the right and in a counter-clockwise direction. This adds a moment of force to arm link 231 to pivot around its low pivot point 260 upon collar 224. Both the counter-clockwise moment force and non-zero or non-negative angle 290, as well as the biasing force of leaf spring 272, help ensure that the links of the roller arm do not lock in a position with their longitudinal axis aligned parallel with the longitudinal axis LA of the centralizer body.

Alternately, the head of bolt 270 offers a perturbance between the exterior wall of body portion 220 and short link 231. If, when arm 231 tends to compress against body portion 220, head of bolt 270 did not encounter a slot or opening in body portion 220, the head could offer an additional means to limit the aligning of short link longitudinal axis AA with longitudinal LA of the centralizer.

Movement of left collar 224 to the right is limited by stop 229 abutting shoulder **237*d* in a slot in body portion 220. Movement of right collar 224 to the left is limited both by the encounter of stop 229 against shoulder 237*a* in a slot opening in body portion 220, as well as the encounter of collar sub 226 against shoulder 238 upon the exterior of body portion 220. Thus, angle 250, as illustrated in FIG. 10, extending between longitudinal axis AA of short link 231 and long link 232**, is prohibited from becoming too small, and the arms are limited in their radial outward extension.

As a further safety feature, short link 231 can carry shoulder 282 that rotates around low pivot point 260 and, forms a stop against further rotation when it encounters wall portion 284 of collar 224.

Having described the invention above, various modifications of the techniques, procedures, material and equipment will be apparent to those in the art. It is intended that all such variations within the scope and spirit of the appended claims be embraced thereby.

I claim:

1. A mechanical roller arm centralizer for centering an oil well tool running in a well bore, comprising:

a body portion having walls defining a longitudinal axis;

a plurality of contact points located on centering arms connected to the body and biased to extend outwardly from the body and wherein a first plane normal to the longitudinal axis of the body drawn through a lowermost contact point has a different longitudinal height than a second plane normal to the longitudinal axis of the body drawn through a next lower contact point that is similarly biased and separated circumferentially by at least 80°.

2. The device of claim 1 wherein first, second and third normal planes drawn through the first lowermost contact point and a second and a third next lower contact point that are separated circumferentially from each other by at least 80° have different longitudinal heights.

3. The device of claim 1 wherein the difference in longitudinal height between the first and the second planes varies between 0.1 inches and 1 inch.

4. The device of claim 1 wherein the centralizer has at least six arms.

5. The device of claim 1 wherein the body includes an unobstructed longitudinal bore.

6. The device of claim 1 wherein each arm is comprised of two links, each link being pivotally connected to a collar portion of the body at one link end and to a rotating contact point assembly at the other end, wherein the collar is adapted for limited sliding motion over an elongated portion of the body, and wherein the limitation to the sliding motion of the collar over the body can be adjusted to regulate the maximum outward extension of the contact point assembly.

7. The device of claim 1 wherein a first plane normal to the longitudinal axis of the body drawn through an uppermost contact point has a different longitudinal height than a second plane normal to the longitudinal axis of the body drawn through a second next upper contact point that is similarly biased and separated circumferentially by at least 80°.

8. The device of claim 7 wherein first, second and third normal planes drawn through the first uppermost point and a second and a third next upper contact point that are separated circumferentially from each other by at least 80° have different longitudinal heights.

9. The device of claim 8 wherein the difference in longitudinal height between the first, the second and the third normal planes varies between 0.1 inches and 1 inch.

10. A method for centralizing a well tool in a string while running in a well comprising:

attaching at least one centralizer to the tool string, the centralizer having outwardly biased centering arms connected to the body and carrying well wall contact points;

lowering the string through the well; and moving a first lowermost contact point into a concentric restriction in the well bore before moving any second most lower contact point, that is similarly biased and separated circumferentially from the first by at least 80°, into the restriction.

11. A mechanical roller arm centralizer for centering an oil well tool running in a well bore, comprising:

a body portion;

a plurality of centering arms pivotally connected to the body, biased outwardly from the body and having rotating contact points; and wherein the contact points form at least two sets of at least two contact points each, the points in each set being of the same longitudinal height and symmetrically spaced around the centralizer body from each other, the points of one set being of a different longitudinal height than the points of the other set, and each set being connected to an independent biasing force.

12. The device of claim 11 wherein the difference in longitudinal height between the lowermost set of points and the next lower set varies between 0.1 inches and 1 inch.

13. A method for centralizing a well tool in a string while running in a well comprising:

attaching at least one centralizer to the tool string, the centralizer having outwardly biased centering arms pivotally connected to the body with rotating contact points;

lowering the string through the well;

compressing a first set of contact points that are symmetrically spaced around the centralizer body, of the same longitudinal height and connected to a first biasing force, by moving the points into a concentric restriction in the well bore; and subsequently compressing a second set of contact points that are symmetrically spaced around the centralizer body, of the same longitudinal height and connected to a second biasing force, by moving the points into the restriction.

14. A mechanical roller arm centralizer for centering an oil well tool running in a well bore, comprising:

a body having walls defining a longitudinal axis;

a plurality of contact points located on centering arms attached to the body and biased outwardly from the body; and means for preventing an arm from axially aligning with the body axis, said means including passing a portion of an arm through an opening in the body wall such that the arm is prevented from axially aligning with the body axis.

15. The device of claim 14 wherein the centering arms define arm axes and that includes means for preventing the angle between an axis of a centering arm and the longitudinal axis of the body from exceeding 45°.

16. The device of claim 14 wherein the preventing means includes offset pivot points for attaching the arms to the body.

17. A mechanical roller arm centralizer for centering an oil well tool running in a well bore, comprising:

a body having walls defining a longitudinal axis;

a plurality of contact points located on centering arms attached to the body and biased outwardly from the body by a biasing element; and wherein at least one arm contacts the biasing element through a cam attached to an end of the arm such that the biasing element imparts a rotational moment to the cam and through the cam to the arm, imparting an outward moment of force to the arm when the arm is collapsed against the body.

* * * * *